US006196960B1

(12) United States Patent
Owensby

(10) Patent No.: US 6,196,960 B1
(45) **Date of Patent: *Mar. 6, 2001**

(54) METHOD FOR IMPARTING A FOOD ADDITIVE AND PACKAGE FOR SAME

(75) Inventor: Joseph E. Owensby, Spartanburg, SC (US)

(73) Assignee: Cryovac, Inc., Duncan, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/105,110

(22) Filed: Jun. 26, 1998

(51) Int. Cl.[7] ..... B65B 43/26

(52) U.S. Cl. ..... 493/220; 493/244; 383/117

(58) Field of Search ..... 493/101, 220, 493/222, 243, 244, 256, 255, 259, 409, 418, 925, 450; 383/107, 108, 116

(56) References Cited

U.S. PATENT DOCUMENTS

| | | | | |
|---|---|---|---|---|
| 815,255 | * | 3/1906 | Bell | 383/107 X |
| 2,905,561 | | 9/1959 | Barnett et al. . | |
| 2,939,259 | | 6/1960 | Heckler . | |
| 3,295,292 | | 1/1967 | Marshak | 53/37 |
| 3,326,096 | * | 6/1967 | Mendoza | 493/309 X |
| 3,360,383 | | 12/1967 | Rose et al. . | |
| 3,383,223 | | 5/1968 | Rose et al. . | |
| 3,617,312 | | 11/1971 | Rose . | |
| 3,645,760 | | 2/1972 | O'Brien et al. . | |
| 3,762,023 | | 10/1973 | Bruce | 29/400 |
| 3,873,737 | | 3/1975 | Hofmann et al. . | |
| 4,052,931 | * | 10/1977 | Morse et al. | 493/101 |
| 4,180,190 | | 12/1979 | Flaum et al. | 223/43 |
| 4,196,220 | | 4/1980 | Chin et al. . | |
| 4,243,074 | * | 1/1981 | Strutzel et al. | 138/118.1 |
| 4,496,757 | * | 1/1985 | Dexter et al. | 560/82 |
| 4,525,418 | * | 6/1985 | Dinklage et al. | 428/264 |
| 4,659,599 | * | 4/1987 | Strutzel | 428/36 |
| 4,834,993 | | 5/1989 | Chiu . | |
| 4,886,697 | * | 12/1989 | Perdelwitz, Jr. et al. | 428/192 |
| 4,917,924 | | 4/1990 | Huang et al. . | |
| 5,206,044 | | 4/1993 | Walton, Jr. . | |
| 5,416,303 | | 5/1995 | Grooms et al. | 219/633 |
| 5,429,702 | | 7/1995 | Grooms et al. | 156/272.4 |
| 5,454,896 | | 10/1995 | Harding et al. | 156/156 |
| 5,483,784 | | 1/1996 | Owensby et al. | 53/459 |
| 5,741,533 | | 4/1998 | Lorenzo Moore et al. . | |

FOREIGN PATENT DOCUMENTS

| | | |
|---|---|---|
| 2183294 | 2/1997 | (CA) . |
| 0 408 164 A2 | 1/1991 | (EP) . |
| 0 373 286 B1 | 12/1993 | (EP) . |
| 0 782 916 A2 | 7/1997 | (EP) . |
| 2258798 | 9/1975 | (FR) . |
| 52-06660 | 6/1977 | (JP) . |
| 53-07507 | 12/1978 | (JP) . |
| 59-179050 | 10/1984 | (JP) . |
| 1253477 | 10/1989 | (JP) . |

OTHER PUBLICATIONS

Chilton's Food Engineering Int. (Apr. 1987, 12 (3) 4/87022 p. 22, (Dialog Abstract).

"Cellostar and Fiberstar, The Packaging Materials with Color Agent for Hams and Sausages" (Osaka Kagaku Gokin K.K.).

* cited by examiner

*Primary Examiner*—David A. Scherbel
*Assistant Examiner*—Anthony Ojini
(74) *Attorney, Agent, or Firm*—Daniel B. Roble

(57) ABSTRACT

A method for providing a package having a coated inner surface involves inverting a package having an inner surface defining an inner space, an outer surface, and a coating on the outer surface. The package can be inverted by application of a vacuum. The coating can be an additive such as a colorant, a flavorant, an antimicrobial agent, or the like.

23 Claims, 1 Drawing Sheet

METHOD FOR IMPARTING A FOOD ADDITIVE AND PACKAGE FOR SAME

BACKGROUND OF THE INVENTION

1. Field of the Invention

The invention relates generally to packaging and, more particularly, to a method for providing packages such as bags and the like having a coating and/or layer on inner surfaces.

2. Background Information

Many food products, for example, ham, beef, turkey and other meat products, are processed or prepared by exposing the surface of the meat product to an additive so as to coat or suffuse the additive into the surface of the meat product. Typical additives include colorants and flavorants. The use of a smoke-containing additive is particularly common, the smoke providing both added flavor and color to the meat product. However, problems are encountered during the exposure of meat surfaces and the like to additives.

For example, during the production of smoked meat products, standard practice in the industry involves first packaging the meat product in a film, cooking the meat product while so packaged, removing the cooked meat from the package, and placing the meat in a smokehouse to impart smoke coloration and flavor. The smoked meat product is thereafter repackaged in another film, and shipped to a wholesaler, retailer or consumer. This type of procedure exposes the cooked meat product to microbial contamination, resulting in shorter shelf life for the cooked meat product, and is also a labor intensive and expensive process for the manufacturer of the smoked cooked meat product. Furthermore, the smoking step is inefficient in that only about 70% of the smoke is effective as a flavorant/colorant, with the remaining 30% of the smoke accumulating on non-food surfaces in the smokehouse, necessitating cleaning and waste deposal. Thus, for a smoked product, providing a packaged product without having to package, cook, unwrap, smoke, and repackage, together with avoiding the handling required for each of these operations, remains desirable within the industry. Such a process could eliminate or at least significantly reduce the potential for microbial contamination, as well as eliminate the waste involved in discarding the original package.

Beyond the specific smoked packaging application, the need remains in the industry for a simple and efficient method for exposing food products to additives such as colorants or flavorants.

The need also remains in the industry for packages and packaging methods which are less labor intensive and less expensive and wherein microbial contamination of the final product is lessened or eliminated.

SUMMARY OF THE INVENTION

Briefly, the present invention provides a method for providing a bag having a coated inner surface. In the method, a bag having an inner surface defining an inner space, an outer surface, and a coating on the outer surface is inverted. The inverting step can include the application of a vacuum to the inner space of the bag so as to turn the bag inside-out. The coating to be positioned on inner surfaces of the bag can be one or more layers of a multilayer bag material or can be a deposited (e.g., spray deposited) coating of a color-transfer material or the like.

The method of the present invention advantageously provides packages having desired material, such as a colorant and/or flavorant, on an inside surface for transfer to food product packaged therein. Additionally, the method minimizes labor requirements and the possibility of microbial contamination while enhancing efficiency of contact of colorant/flavorant with the food product.

BRIEF DESCRIPTION OF THE DRAWINGS

A detailed description of illustrative embodiments of the present invention follows, with reference to the attached drawings, wherein.

DETAILED DESCRIPTION OF ILLUSTRATIVE EMBODIMENTS

The method of the present invention provides a package such as a bag having a coating or additive layer on inner surfaces thereof. More particularly, the invention relates to a method wherein a package or bag is provided having the coating or layer positioned on an outer surface, and the package is subsequently inverted so as to position the desired coating or layer on the inside of the package. Such a package can be used with a food product to, for example, expose the surface of the food product to the coating or additive layer. The coating or additive layer can be, for example, a colorant or flavorant.

The following description is provided in terms of a bag package structure. Of course, the description of these illustrative embodiments is readily applicable to other shapes of packages and the like.

Figure 1:
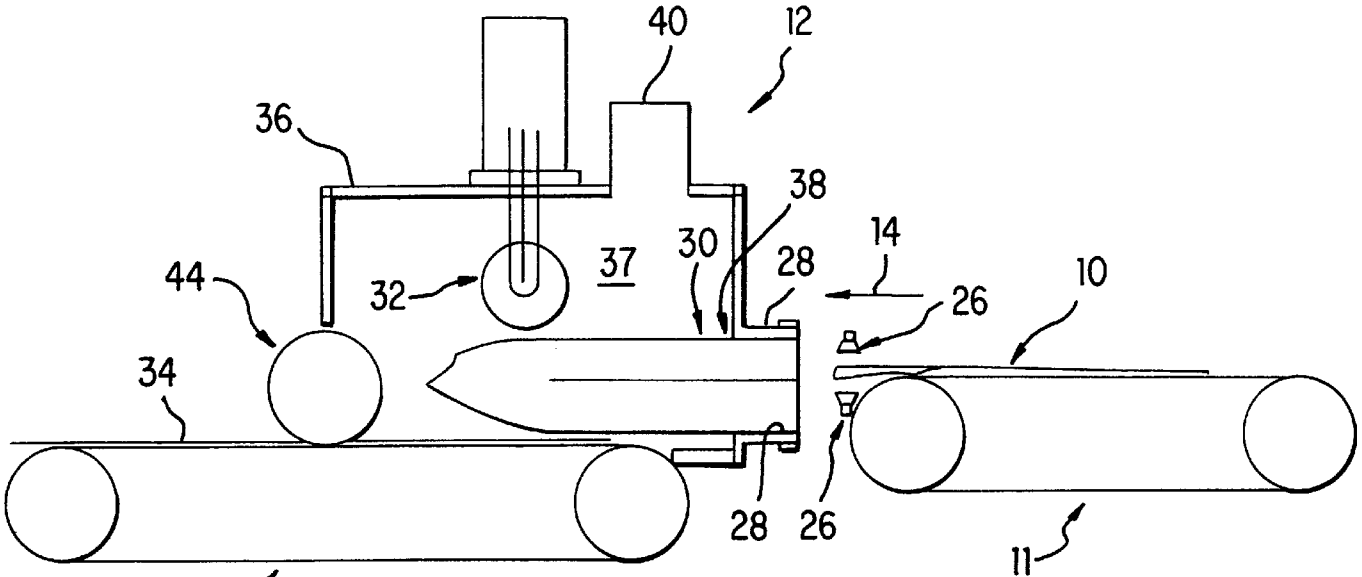
FIG. 1 is a side schematic view of a method in accordance with the present invention.

FIG. 1 is a pictorial representation of a method whereby a bag 10 having a coating 24 on an outside surface is fed to an inverting station 12 where the bag is inverted or turned inside-out so as to position the coating or layer of the bag on an inside surface of the bag. Bag 10 advantageously can be manufactured with desired coatings or additives such as colorant and/or flavorant materials positioned on an outer surface of the bag. Inversion of the bag repositions these materials on inner surfaces thereof for contact with food products and the like to be packaged therein.

Figure 2:
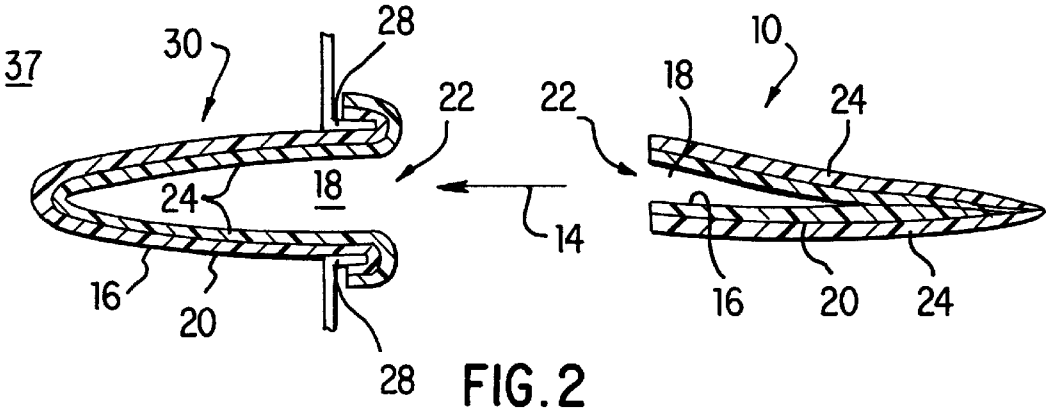
FIG. 2 further illustrates various features of a bag being inverted in accordance with the present invention.

Referring to FIGS. 1 and 2, bag 10 initially is provided having an inner surface 16 defining an inner space 18, an outer surface 20, and an open end 22.

Bag 10 initially can be provided such that coating 24 is positioned on outer surface 20 (as shown in FIG. 2). Optionally coating 24 may include a primer and/or a protective layer as is discussed in greater detail below. Bag 10 typically is conveyed from a bag forming station along a conveyor 11 in a direction of movement indicated by arrow 14, for example with open end 22 oriented facing forward with respect to the direction of movement.

Bag 10 is fed along conveyor 11 to a station for at least partially opening the bag by, for example, spreading open end 22 with a vacuum cup transfer mechanism 26 as is well known in the art. Vacuum cup transfer mechanism 26 advantageously serves to at least partially open bag 10 to a position where side walls of the bag are spaced. This allows bag 10 to be positioned over horns 28 of inverting station 12 so that a vacuum can be applied to the inner space 18 of bag 10 as desired.

Inverting station 12 can include a substantially closed chamber 36 defining an inner space 37 and having an opening 38. Horns 28 can be positioned around opening 38, and a vacuum source 40 can communicate with inner space 37. Once bag 10 is positioned over horns 28, chamber 36 is evacuated by vacuum source 40 so as to apply a reduced pressure to inner space 18 of bag 10. This reduced pressure rapidly draws bag 10 through opening 38 and horns 28 into chamber 36 so as to provide the desired inside-out or inverted bag 30.

As shown in FIG. 1, open end 22 can be drawn over horns 28 at inverting station 12 so as to communicate inner space 18 of bag 10 with inner space 37 of chamber 36. At this point, reduced pressure or vacuum can be applied to inner space 18 of bag 10 from vacuum source 40. The reduced pressure pulls bag 10 through horns 28 and into inner space 37 of chamber 36 to a substantially inverted or inside-out configuration. Thus, inverting station 12 provides bags 30 in an inverted condition wherein outer surface 20 and coating 24 are positioned facing inwardly as desired and wherein inner surface 16 is positioned facing outwardly.

Still referring to FIG. 1, inverted bag 30 can be removed from horns 28 using, for example, a stomper roll device 32 as is well known in the art. This can provide a substantially flattened inverted bag 34 which can be conveyed to other stations for loading and/or further treatment for storage, transportation, or the like as desired.

The inverted bag 30 in inverting station 12 is initially in an at least partially open position wherein side walls of bag 10 are spaced. Inverted bag 30 can be removed from horns 28 using stomper roll device 32 as described above or using some other structure which disengages open end 22 from horns 28 and at least partially flattens inverted bags on a conveyor 42 for transferring inverted bags 30 to subsequent stations. A discharge roll device 44 also can be provided to complete the flattening of inverted bags 30 on conveyor 42 so as to provide substantially flattened inverted bags 34 from inverting station 12 wherein side walls of inverted bags 34 are in contact with each other.

The method of the present invention applies to treatment of a wide variety of bags or other packages which can, of course, be provided having diverse types of layers, additives, and/or other compositions depending upon the product to be packaged. Thus, the method of the present invention is applicable to any type of package wherein it is desirable to provide a coating, additive, or layer on an inner surface, especially where a reduced or minimized amount of mechanical contact with such layer or other microbial exposure of package layers and food products to be contained therein is desired.

Representative coating materials or additives include, but are not limited to, flavorants (including liquid smoke and spices such as, for example, pepper), fragrances, colorants, antimicrobial agents, antioxidants, oxygen scavengers, chelating agents, and odor or moisture sorbers. Specific examples of potentially useful additives include one or more of caramel, liquid smoke, natural brown, annatto extract, beet powder, canthaxanthin, β-Apo-8'-carotenal, carotene, cochineal extract, carmine, grape color extract, synthetic iron oxide, paprika, riboflavin, titanium oxide, malt, natural colorant, spice, bacteriocin, allyisothiocyanate, monolaurin, 1-[2-(2,4-dichlorophenyl)-2-(propenyloxy)ethyl]-1H-imidazole, silver, benzoic acid, benzoate, hydroxycinnamic acid derivative, essential oils, sorbic acid, salt of sorbic acid, benzoate, methyl p-hydroxybenzoate, propyl p-hydroxybenzoate, p-hydroxybenzoic acid, sodium benzoate, propionic acid, salt of propionic acid, sodium lactate, dimethyl dicarbonate, diethyl dicarbonate, sulfite, diethyl pyrocarbonate, EDTA, butylated hydroxyanisole, butylated hydroxytoluene, propyl gallate, dilauryl thiodipropionate, thiodipropionic acid, gum guaiac, tocopherol, acetate, citrate, gluconate, oxystearin, orthophosphate, meta-phosphate, pyro-phosphate, polyphosphate, phytate, sorbitol, tartrate, thiosulfate, and lysozyme.

Additionally, one or more FD&C colorants can be used as or included in the additive. Examples of useful FD&C colorants include, but are not limited to:

- Blue No. 1—disodium salt of 4-((4-(N-ethyl-p-sulfobenzylamino)-phenyl-(2sulfoniumphenyl)-methylene)-(1-(N-ethyl-N-p-sulfobenzyl)-sup2,5-cyclohexadienimine)
- Blue No. 2—disodium salt of 5,5',-indigotin disulfonic acid
- Green No. 3—disodium salt of 4-((4-(N-ethyl-p-sulfobenzylamino)-phenyl-(4hydroxy-2-sulfonium phenyl)-methylene)-(1-(-N-ethyl-N-psulfobenzyl)-sup2,5-cyclohexadienimine)
- Green No. 6—1,4-di-toluidinoanthraquinone
- Red No. 3—disodium salt of erythrosin
- Yellow No. 5—trisodium salt of 3-carboxy-5-hydroxy-1-p-sulfophenyl-4sulfophenylazopyrazole
- Yellow No. 6—disodium salt of 1-p-sulfophenylazo-2-naphthol-6-sulfonic acid.

When the additive includes a colorant and the package is subjected to a standard mottling test, the package preferably exhibits a Gray Scale standard deviation of less than about 20, more preferably less than about 18, even more preferably less than about 16, still more preferably less than about 14, and most preferably less than about 12.

In addition to the additives set forth above, additional materials may be used in the coating to be positioned on the inner surfaces in accordance with the present invention. These additional materials include binders, crosslinking agents, plasticizers, primers, overcoat or protective materials, and the like.

Where a binder is used, it can include one or more of alginate, methyl cellulose, hydroxypropyl starch, hydroxypropylmethyl starch, hydroxymethyl cellulose, hydroxypropyl cellulose, hydroxypropylmethyl cellulose, carboxymethyl cellulose, cellulose esterified with 1-octenyl succinic anhydride, chitin, chitosan, gliadin, glutenin, globulin, albumin (especially in the form of gluten), prolamin (especially corn zein), thrombin, pectin, carrageenan, konjac flour-glucomannin, fibrinogen, casein (especially casein milk protein), soy protein (especially soy protein isolates), whey protein (especially whey milk protein), and wheat protein.

Another type of binder is based on a derivatized polysaccharide. In this type of binder, one or more polysaccharide are (A) esterified with at least one of acetic anhydride, propionic anhydride, alkyl-propionic anhydride, butyric anhydride, alkyl-butyric anhydride, succinic anhydride, alkyl-succinic anhydride, maleic anhydride, alkyl-maleic anhydride, adipic anhydride, alkyl-adipic anhydride, and vinyl acetate; (B) etherified with at least one of acrolein, epichlorihydrin, ethylene glycol, ethylene glycol oligomer, propylene glycol, propylene glycol oligomer, ethylene oxide, and propylene oxide; (C) esterified with an anhydride of the formula $[CH_3(CH_2)n—CO]_2—O$, where n is an integer from 0 to 6, as well as alkyl-substituted derivatives thereof; or (D) esterified with an acid chloride of the formula $CH_3(CH_2)n—COCl$, where n is an integer from 0 to 6, as well as alkyl-substituted derivatives thereof.

Where more than one binder is used, one or more thereof preferably are selected from each of A and B: (A) alginate, methyl cellulose, hydroxypropyl starch, hydroxypropylmethyl starch, hydroxymethyl cellulose, hydroxypropyl cellulose, hydroxypropylmethyl cellulose, carboxymethyl cellulose, cellulose esterified with 1-octenyl succinic anhydride, chitin, and chitosan; and (B) gliadin, glutenin, globulin, albumin (especially in the form of gluten), prolamin (especially corn zein), thrombin, pectin, carrageenan, konjac flour-glucomannin, fibrinogen, casein (especially casein milk protein), soy protein, whey protein (especially whey milk protein), and wheat protein.

The additive preferably is affiliated to the binder through one or more of a covalent bond, an ionic bond, a hydrogen bond, and dipole-dipole interaction.

In addition to the aforementioned additives and binders, one or more crosslinking agents can be included in the mixture that is coated on the bag. Crosslinking agents can provide a crosslinked network in which the additive(s) are securely confined until the heat involved in cooking releases them into or onto a product contained in the bag. Where a crosslinking agent is used, it preferably includes one or more of malose, glutaraldehyde, glyoxal, dicarboxylic acid, ester of dicarboxylic acid, urea formaldehyde, melamine formaldehyde, trimethylol-melamine, organic compounds including a plurality of sulfhydryl groups, and liquid smoke that includes a component with at least two carbonyl groups.

Additionally or alternatively, one or more plasticizers can be included in the mixture coated on the bag. Non-limiting examples of useful plasticizers include, but are not limited to, polyols, sodium citrate, and triethyl citrate.

Advantageously, the coating can be applied directly to the outer layer of the bag. However, if desired, a primer can be included between the coating and the outside layer. Such a primer can be applied to the outside layer of the bag prior to application of the coating. Examples of materials that can be included in a primer include polysaccharides and proteins, particularly one or more of alginate, methyl cellulose, hydroxypropyl starch, hydroxypropylmethyl starch, hydroxymethyl cellulose, hydroxypropyl cellulose, hydroxypropylmethyl cellulose, carboxymethyl cellulose, cellulose esterified with 1-octenyl succinic anhydride, chitin, chitosan, gliadin, glutenin, globulin, albumin (especially in the form of gluten), prolamin (especially corn zein), thrombin, pectin, carrageenan, konjac flour-glucomannin, fibrinogen, casein (especially casein milk protein), soy protein, whey protein (especially whey milk protein), and wheat protein. Additionally or alternatively, the primer can contain one or more additives such as those which can be present in the coating, a release agent, and/or a crosslinking agent.

Although the coating need not be covered with a protective layer, an overcoat can be employed. Examples of materials that can be included in an overcoat include polysaccharides and proteins, particularly one or more of alginate, methyl cellulose, hydroxypropyl starch, hydroxypropylmethyl starch, hydroxymethyl cellulose, hydroxypropyl cellulose, hydroxypropylmethyl cellulose, carboxymethyl cellulose, cellulose esterified with 1-octenyl succinic anhydride, chitin, chitosan, gliadin, glutenin, globulin, albumin (especially in the form of gluten), prolamin (especially corn zein), thrombin, pectin, carrageenan, konjac flour-glucomannin, fibrinogen, casein (especially casein milk protein), soy protein, whey protein (especially whey milk protein), and wheat protein. Additionally or alternatively, the overcoat can contain one or more additives such as those which can be present in the coating, a release agent, and/or a crosslinking agent.

Examples of materials from which the bag can be made include, but are not limited to, paper and paper-like materials, foils, cellulosic materials (e.g., those used for cook-in casings), thermoplastic films, and laminates of any of the foregoing. (Where the bag is made from or includes a thermoplastic film, the types of polymers that can be included in one or more of the film layers include polyolefins, polyamides, ethylene/vinyl alcohol interpolymers, polyesters, and the like.) Thermoplastic films are particularly advantageous. When the package or bag is made of a film material, the film from which the bag is made can be a single-layer or multi-layer film. Where the film has only one layer, that layer must be able to seal to itself so that the bag can be formed. Additionally, that layer advantageously can exhibit good adhesion to the food product to be enclosed in the bag.

The film from which the bag is made may include more than one layer. The layers of such a film can be classified according to their purpose such as, for example, food-contact layer, sealant layer(s), abuse layer(s), bulk layer(s), oxygen barrier layer(s), moisture barrier layer(s), tie layer (s), etc. Those of ordinary skill in the art are aware of the plethora of polymers and polymer blends that can be included in each of the foregoing. Regardless of the particular structure of a given multilayer film, it can be used to make and invert a bag according to the present invention as long as it can be sealed to itself in a manner that provides a seal sufficiently strong to survive cook-in conditions such as those described previously.

The following are some examples of combinations in which letters are used to represent film layers:

A/B, A/B/A, A/B/C, A/B/D, A/B/E, A/B/C/D, A/B/C/E, A/B/E/E', A/B/D/E,

A/B/D/C, A/B/C/B/A, A/B/C/D/A, A/B/E/B/A, A/B/C/D/E, A/B/C/E/D,

A/B/D/C/D, A/B/D/C/E, A/B/D/E/C, A/B/D/E/E', A/B/E/C/E, A/B/E/C/D,

A/B/E/D/D', A/B/E/D/E wherein

A represents a food-contact layer and/or a sealant layer;

B represents a bulk layer or a sealant layer (depending on whether it is present as an inner or outer layer of the film);

C represents a layer including a polymer having a low permeance to oxygen and/or moisture;

D and D' represent bulk and/or abuse layers (depending on whether they are present as an inner or outer layer of the film); and E and E' represent abuse layers.

Of course, one or more tie layers can be used in any of the above structures. Additionally, adjacent layers may have different compositions.

Regardless of the structure of the film, one or more conventional packaging film additives can be included therein. Examples of additives that can be incorporated include, but are not limited to, antiblocking agents, antifogging agents, slip agents, colorants, flavorants, antimicrobial agents, meat preservatives, and the like. Where the multilayer film is to be processed at high speeds, inclusion of one or more antiblocking agents in and/or on one or both outer layers of the film structure can be used. Examples of useful antiblocking agents for certain applications are corn starch and ceramic microspheres.

The film for use in the present invention may suitably exhibit a sufficient Young's modulus so as to withstand normal handling and use conditions. It preferably has a Young's modulus of at least about 200 MPa, more preferably at least about 230 MPa, even more preferably at least about 260 MPa, still more preferably at least about 300 MPa, yet still more preferably at least about 330 MPa, even further more preferably at least about 360 MPa, and most preferably at least about 400 MPa. (Young's modulus is measured in accordance with ASTM D 882, the teaching of which is incorporated herein by reference.) The film may exhibit a shrink tension in at least one direction of at least about 0.33 MPa, more preferably at least about 0.67 MPa. The film preferably exhibits a shrink tension of from about 0.67 to about 3.5 MPa, more preferably from about 1 to about 3.3 MPa, even more preferably from about 1.25 to about 3.1 MPa, still more preferably from about 1.5 to about 3 MPa, yet still more preferably from about 1.6 to about 2.9 MPa, and most preferably from about 1.75 to about 2.75 MPa.

The film may be sequentially or biaxially oriented, more preferably biaxially oriented. Orienting involves initially cooling an extruded film to a solid state (by, for example, cascading water or chilled air quenching) followed by reheating the film to within its orientation temperature range and stretching it. The stretching step can be accomplished in many ways such as by, for example, "blown bubble" or "tenter framing" techniques, both of which are well known to those skilled in the art. After being heated and stretched, the film is quenched rapidly while being maintained in its stretched configuration so as to set or lock in the oriented molecular configuration. An oriented film can be annealed to reduce or completely eliminate free shrink in one or more directions.

The film may be heat shrinkable. More preferably, the film is biaxially oriented and heat shrinkable. Even more preferably, the film is biaxially oriented and has a free shrink at 85° C. in each of the longitudinal (L) and transverse (T) directions of at least about 10%, preferably of at least about 15. If heatshrinkable, the film from which the bag is made preferably has a free shrink at 85° C. in at least one direction (i.e., the L or T direction) of from about 5 to about 70%, more preferably from about 10 to about 50%, and most preferably from about 15 to about 35%. At 85° C., the film preferably has a total free shrink (i.e., L+T) of from about 5 to about 150%, more preferably from about 10 to about 120%, even more preferably from about 15 to about 110%, still more preferably from about 20 to about 105%, yet still more preferably from about 30 to about 100%, even further more preferably from about 35 to about 95%, yet further more preferably from about 40 to about 90%, and most preferably from about 45 to about 85%. (As used herein, "free shrink" refers to the percent dimensional change in a 10 cm×10 cm specimen of film when shrunk at 85° C. in accordance with ASTM D 2732, as set forth in the 1990 *Annual Book of ASTM Standards*, vol. 08.02, pp. 368–71, the teaching of which is incorporated herein by reference.)

The measurement of optical properties of plastic films, including the measurement of total transmission, haze, clarity, and gloss, is discussed in detail in Pike, LeRoy, "Optical Properties of Packaging Materials", *Journal of Plastic Film & Sheeting*, vol. 9, no. 3, pp. 173–80 (July 1993), which is incorporated herein by reference. Specifically, haze is a measurement of the transmitted light scattered more than 2.5° from the axis of the incident light. It is measured with a meter similar to a total light transmission meter, with the exception that it contains a light trap to absorb light scattered less than 2.5° as well as regular transmitted light. Commonly, the total transmitted light is measured first by defeating the light trap and then setting the meter to 100. Then the light trap is allowed to absorb the light scattered less than 2.5° (plus regular transmitted light), and haze is read as a percentage of total transmitted light. Note that the denominator here is total transmitted light ($I_s+I_r$), not incident light ($I_i$), as in the measurement of total transmitted light.

The haze of a particular film is determined by analyzing it in accordance with 1990 *Annual Book of ASTM Standards*, section 8, vol. 08.01, ASTM D 1003, "Standard Test Method for Haze and Luminous Transmittance of Transparent Plastics", pp. 358–63, which is incorporated herein by reference. Haze results can be obtained using instrumentation such as, for example, an XL 211 HAZEGARD™ system, (Gardner/Neotec Instrument Division; Silver Spring, Maryland), which requires a minimum sample size of about 6.5 $cm^2$.

The film from which the bag is made preferably has a haze of less than about 20%, more preferably of less than about 15%, even more preferably less than about 10%, still more preferably less than about 7.5%, and most preferably less than about 5%.

As used herein, "thickness uniformity" refers to a percent value obtained from the formula $$U_t=100-[(t_{max}-t_{min})/t_{max}]\times 100]$$

where $U_t$ is thickness uniformity (calculated as a percentage), $t_{max}$ is the measured maximum thickness, and $t_{min}$ is the measured minimum thickness. The maximum and minimum thicknesses are determined by taking a number of thickness measurements (e.g., 10) at regular distance intervals along the entirety of the transverse direction of a film sample, recording the highest and lowest thickness values as the maximum and minimum thickness values, respectively, and computing the thickness uniformity (a percent value) using the formula above. A thickness uniformity of 100% represents a film with perfect uniformity, i.e., no measurable differences in thickness. A film in which the film $t_{min}$ is measured at 45% of the film $t_{max}$ has a thickness uniformity of only 45%.

The film preferably has a thickness uniformity of at least 30%, more preferably at least 40%, even more preferably at least 50%, still more preferably at least 60%, yet still more preferably at least 70%, even further more preferably at least 80%, and most preferably at least 85%.

The film from which the bag is made can have any total thickness as long as the film provides the desired properties for the particular packaging operation in which the bag is to be used. Nevertheless, the film preferably has a total thickness of from about 0.0075 to about 0.25 mm, more preferably from about 0.0125 to about 0.125 mm, more preferably from about 0.025 to about 0.1 mm, even more preferably from about 0.0375 to about 0.09 mm, and most preferably from about 0.045 to about 0.075 mm.

The film can be irradiated and/or corona treated. The former technique involves subjecting a film material to radiation such as corona discharge, plasma, flame, ultraviolet, X-ray, gamma ray, beta ray, and high energy electron treatment, any of which can alter the surface of the film and/or induce crosslinking between molecules of the polymers contained therein. The use of ionizing radiation for crosslinking polymers present in a film structure is disclosed in U.S. Pat. No. 4,064,296 (Bornstein et al.), the teaching of which is incorporated herein by reference. Irradiation is believed to increase interply adhesion by crosslinking the ethylene/α-olefin interpolymer of the second layer (which is a very soft material having a low modulus), to improve the sealability of the film, to reduce edge tear, and to give the film structural integrity and seal strength sufficient to better survive cook-in conditions.

If desired or necessary to increase adhesion to an enclosed meat product, all or a portion of the film can be corona and/or plasma treated. Corona/plasma treatment involves bringing a film material into the proximity of an $O_2$— or $N_2$ containing gas (e.g., ambient air) which has been ionized. Various forms of plasma treatment known to those of ordinary skill in the art can be used to corona treat an outer surface of a thermoplastic film material. Exemplary techniques are described in, for example, U.S. Pat. No. 4,120,716 (Bonet) and U.S. Pat. No. 4,879,430 (Hoffman), the disclosures of which are incorporated herein by reference. Regardless of whether or not the film is corona treated, at least the inside (i.e., protein contact) layer thereof preferably has a surface energy of at least about 0.032 $J/m^2$, more preferably at least about 0.034 $J/m^2$, even more preferably at least about 0.036 $J/m^2$, still more preferably at least about 0.038 $^{J/m2}$, yet still more preferably at least about 0.040 $J/m^2$, even further more preferably at least about 0.042 $J/m^2$, and most preferably at least about 0.044 $J/m^2$.

In another embodiment, especially where the bag is to be used with whole muscle products, the food-contact layer of the film from which the bag is made preferably is relatively non-polar. In such applications, providing a food-contact layer with a low surface energy can be desirable so as avoid pulling off chunks of the whole muscle product when the film is stripped from the product. In such instances, the surface energy of the layer in question preferably is less than about 15 0.034 $J/m^2$, more preferably less than about 0.032 $J/m^2$, and most preferably less than about 0.030 $J/m^2$.

The film preferably can survive cooking for at least two hours, without undergoing delamination or seal failure, at about at least 65° C., more preferably at about at least 70° C., even more preferably at about at least 75° C., still more preferably at about at least 80° C., and most preferably at about at least 85° C.

Preferably, the film of the present invention is capable of surviving cooking at the foregoing temperatures for at least about 3 hours, more preferably at least about 5 hours, and most preferably at least about 8 hours. The product being cooked preferably is a meat.

A package or bag can be made according to the present invention by sealing to the bag an outer layer, whereby that layer becomes the inside layer of the bag after inversion. The bag can be an end-seal bag, a side-seal bag, an L-seal bag (i.e., sealed across the bottom and along one side with an open top), or a pouch (i.e., sealed on three sides with an open top). Additionally, lap seals can be employed. Preferably, the bag is made from a continuous length of tubing; this type of bag does not have a seam along the length of the bag which can deleteriously affect the aesthetic appearance of the bag.

The bag can be used to package a variety of products, although it optimally can be used to package proteinaceous food products, particularly meat products. Examples of meat products that can be packaged include, but are not limited to, poultry (e.g., turkey or chicken breast), bologna, braunschweiger, beef, pork, and whole muscle products such as roast beef.

The packaging just described can be done by first forming and inverting a bag (as described above), introducing the product into the bag, then sealing the open side of the bag. Where such a bag is made from a heat shrinkable film, the film can shrink around the product when it is subjected to heat. Where the product being packaged is a food product, it can be cooked by subjecting the entire bag to an elevated temperature for a time sufficient to effectuate the degree of cooking desired.

Bag 10 having coating 24 initially on the outer surface thereof may advantageously be provided for inversion according to the method of the present invention through a number of bag manufacturing techniques, for example by coating a film which is then backseamed and made into bags, or by coating a bag tubing which is subsequently made into bags, and then inverted by the method of the present invention. Of course, other methods of providing the starting bag or package material could be used as well.

In further accordance with the present invention, it is noted that bag 10 treated in accordance with the process of the present invention are maintained under the control of at least one component of the system for carrying out the method throughout the entire procedure. For example, bags are initially positioned securely in a substantially flat position on inlet conveyor 11, and are then grasped by vacuum cup transfer mechanism 26 so as to be securely positioned on horns 28 during inversion. Inverted bags 30 are then controlled by a combination of stomper roll device 32 and discharge roll device 44 so as to position substantially flattened inverted bags 34 securely on conveyor 42. Through each of these steps, bags are maintained in positive control so as to facilitate additional handling such as taping and the like, and further to allow incorporation of the method of the present invention into existing bag making machines with a minimum amount of adaptation. Further, this provides for enhancement of efficiency of labor and additive utilization, and reduces the possibility of microbial exposure.

Although the application of vacuum to invert coated bags to provide the coating on an inside surface is advantageous, other methods of inverting coated bags are within the broad scope of the method of the present invention.

The method of the present invention is not limited to the illustrations described and shown herein, which are deemed to be merely illustrative, and which are susceptible to modification of form, size, arrangement of parts and details of operation. The invention rather is intended to encompass all such modifications which are within its spirit and scope as defined by the claims.

I claim:

1. A method for providing a flexible package adapted for imparting a food additive to a food product placed within the flexible package, said method comprising:

a) forming a flexible package defining an inner space within said flexible package and an outer space outside said flexible package;

b) subsequently depositing a coating having a food addtive on said flexible package while the flexible packaging is in a first position so that said coating is adjacent said outer space; and c) subsequently inverting said flexible package to a second position in which said coating is adjacent said inner space.

2. The method of claim 1 wherein said depositing step includes depositing a coating comprising at least one food additive selected from the group consisting of flavorants, fragrances, colorants, antimicrobial agents, antioxidants, chelating agents, odor absorbents and mixtures thereof.

3. The method of claim 1 wherein said package comprises a bag having an open end and said inverting step comprises conveying said bag in a direction of movement to an inverting station with said open end facing forward relative to said direction of movement, and wherein said inverting step provides an inverted bag with said open end facing rearward relative to said direction of movement.

4. The method of claim 1 wherein said package is formed from a wall structure comprising a material selected from the group consisting of paper, foil, cellulosic material, thermoplastic film, and laminates of combinations thereof.

5. The method of claim 1 wherein said forming step includes forming a flexible package comprising a heat shrinkable material.

6. The method of claim 1 wherein:

said forming step provides a flexible package comprising a multilayered material; and said depositing step provides a coating comprising at least two layers.

7. The method of claim 1 wherein said depositing step includes depositing a coating further comprising a protective layer.

8. The method of claim 1 wherein said depositing step includes depositing a coating further comprising a primer layer.

9. The method of claim 1 wherein said depositing step includes depositing a coating further comprising at least one material selected from the group consisting of binders, crosslinking agents, plasticizers, and mixtures thereof.

10. The method of claim 1 wherein said depositing step includes depositing a coating comprising a color-transfer food additive material.

11. The method of claim 1 wherein said depositing step includes depositing a coating comprising a flavor-transfer food additive material.

12. The method of claim 1 wherein said forming step includes forming a flexible package comprising a thermoplastic material, said package selected from the group consisting of an end-seal bag, a side-seal bag, an L-seal bag, and a pouch.

13. A method for imparting a food additive to a food product, the method comprising:

forming a flexible package including a film comprising at least one thermoplastic material, the flexible package defining an interior space within the flexible package and an exterior space outside the flexible package;

subsequently depositing on the package a coating adjacent the exterior space, the coating comprising a food additive;

turning the flexible package inside-out to place the coating adjacent the interior space; and subsequently placing the food product into the interior space of the flexible package.

14. The method of claim 13 wherein the depositing step includes depositing at least two layers.

15. The method of claim 13 wherein the depositing step includes depositing a coating comprising a protective layer.

16. The method of claim 13 wherein the depositing step includes depositing a coating comprising a primer layer.

17. The method of claim 13 wherein the depositing step includes depositing a coating comprising at least one material selected from the group consisting of binders, crosslinking agents, plasticizers, and mixtures thereof.

18. The method of claim 13 wherein the depositing step includes depositing a coating comprising at least one food additive selected from the group consisting of flavorants, fragrances, colorants, antimicrobial agents, antioxidants, chelating agents, odor absorbents, and mixtures thereof.

19. The method of claim 13 wherein the depositing step includes depositing a coating comprising a color-transfer food additive material.

20. The method of claim 13 wherein the depositing step includes depositing a coating comprising a flavor-transfer food additive material.

21. The method of claim 13 wherein the forming step includes forming a flexible package comprising a heat shrinkable material.

22. The method of claim 13 wherein the forming step includes forming a flexible package selected from the group consisting of an end-seal bag, a side-seal bag, an L-seal bag, and a pouch.

23. The method of claim 13 wherein the placing step forms a packaged food and further comprising the step of exposing the packaged food to an elevated temperature for a time sufficient to cook the food.

* * * * *

UNITED STATES PATENT AND TRADEMARK OFFICE

CERTIFICATE OF CORRECTION

PATENT NO. : 6,196,960 B1
DATED : March 6, 2001
INVENTOR(S) : Joseph E. Owensby

It is certified that error appears in the above-identified patent and that said Letters Patent is hereby corrected as shown below:

Column 10,
Line 43, "addtive" should be "additive"

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*